US006491162B2

(12) United States Patent
Barham

(10) Patent No.: US 6,491,162 B2
(45) Date of Patent: Dec. 10, 2002

(54) TROWEL COVER

(76) Inventor: William Gene Barham, 0568 Drain Mountain Dr., Eagle, CO (US) 81631

( * ) Notice: Subject to any disclaimer, the term of this patent is extended or adjusted under 35 U.S.C. 154(b) by 0 days.

(21) Appl. No.: 09/851,047

(22) Filed: May 8, 2001

(65) Prior Publication Data

US 2002/0166783 A1 Nov. 14, 2002

(51) Int. Cl.[7] ..... A45C 11/26; B65N 65/02
(52) U.S. Cl. ..... 206/349; 150/161
(58) Field of Search ..... 206/349; 150/161, 150/154; 30/286; 15/235.4, 244.1

(56) References Cited

U.S. PATENT DOCUMENTS 2,190,811 A 2/1940 Van Zeeland
2,517,649 A 8/1950 Frechtmann
2,528,059 A 10/1950 Kendrick
2,952,028 A 9/1960 Robbins
5,530,984 A * 7/1996 Walker ..... 15/209.1
5,632,569 A * 5/1997 Szmansky ..... 15/235.4

OTHER PUBLICATIONS

Disclosure Document of William G. Barham and John W. Barham—Protective Slip Towel.

* cited by examiner

*Primary Examiner*—Bryon P. Gehman
(74) *Attorney, Agent, or Firm*—Rick Martin; Patent Law Offices of Rick Martin, PC

(57) ABSTRACT

Trowels have sharp edges which can cut a worker when he places the trowel down in a resting position. The present invention provides a plastic sheath to insert the trowel into during the resting mode of use. This sheath also prevents nicks and dents to the trowel while it is transported in a bucket. An optional sharpening file is attached to the top of the sheath. The plastic sheath has a clamp that prevents the sheath from falling off the trowel during transport. A drain hole on the bottom of the sheath allows water to drain off to reduce rust on the trowel.

18 Claims, 4 Drawing Sheets

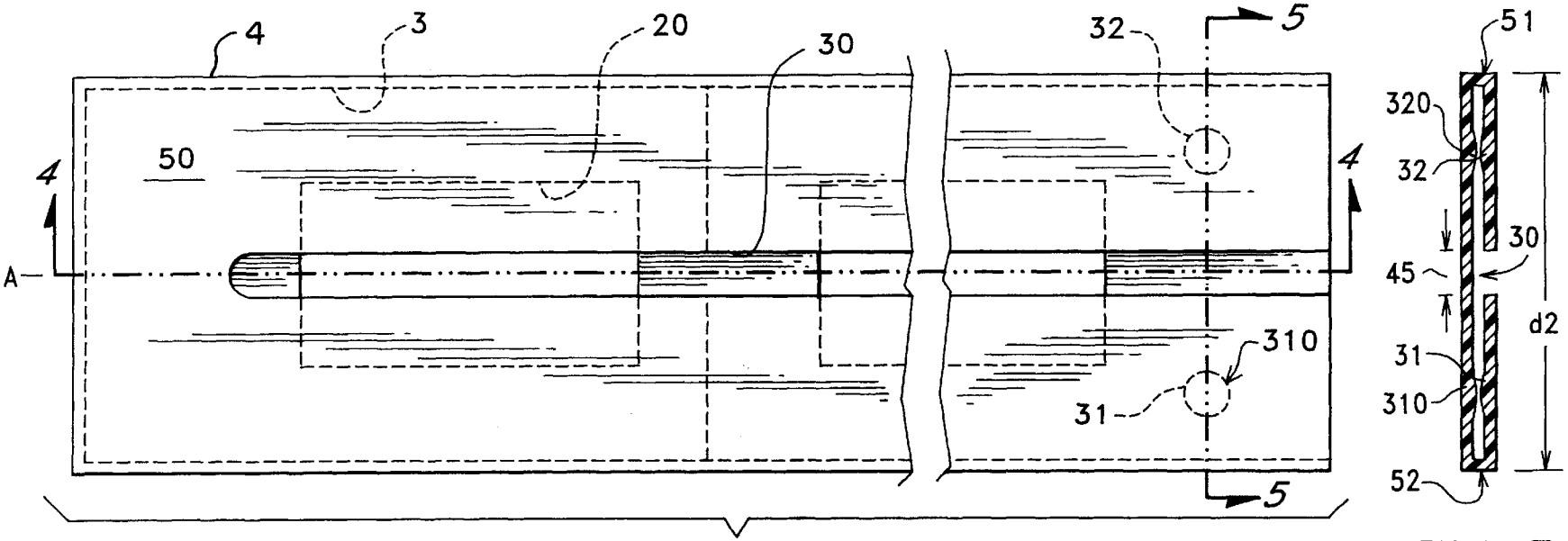
FIG. 3
FIG. 5
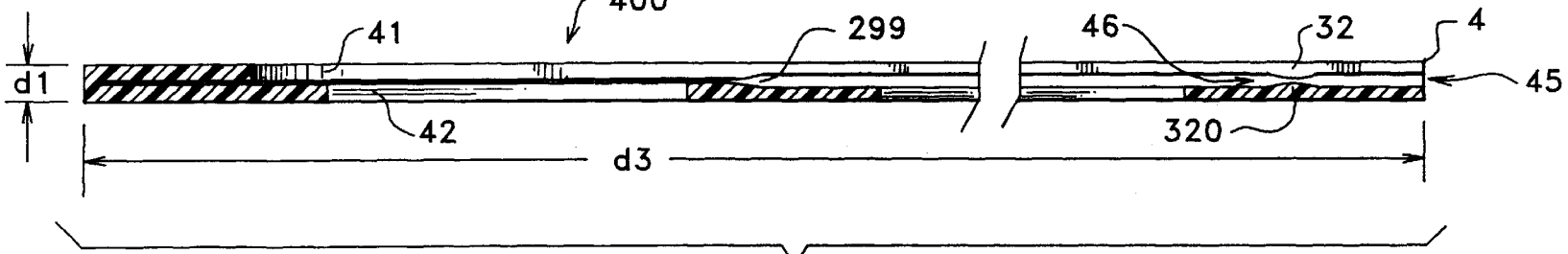
FIG. 4

TROWEL COVER

FIELD OF INVENTION

The present invention relates to a slip on plastic cover for a cement and plastering trowel.

BACKGROUND OF THE INVENTION

A cement/plastering trowel will be called a mason's trowel herein. A mason's trowel has a rectangular working surface which is slightly convex running along a longitudinal axis of the working surface. The outside longer edges curve upward.

Noted below are references which tried but failed to provide a protective sheath for the mason's trowel. U.S. Pat. No. 2,952,028 (1960) to Robbins discloses a mason's trowel guard made of metal. The inside gripping edges are coarse so as to sharpen the long side edges of the trowel. No explanation is provided to explain how a convex working blade is held in place by a pair of slots having parallel edges. If the slot is larger than the blade, then the blade will fall out. If the slot is smaller than the blade, then the blade can't be fit inside the (metal) slot without some type of prying action to open the slot.

U.S. Pat. No. 2,190,811 (1940) to Zeeland discloses a rubber and felt cover stretched over the bottom of a triangular trowel to provide a smooth working surface for the blade in plastering applications.

U.S. Pat. No. 2,528,059 (1948) to Kendrick discloses a knife sheath having a release catch.

U.S. Pat. No. 2,517,649 (1949) to Frechtmann discloses a knife blade guard made of a plastic rod having a slot to receive the blade.

What is needed in the art is a flexible sheath for a mason's trowel which will not fall off from any angle during transport. Another needed feature is a sheath with drainage holes for washing with water. Another needed feature is a sheath having a built in file for sharpening the blade. The present invention provides all of these features, which are deemed new, useful and non-obvious in the art.

SUMMARY OF THE INVENTION

The primary aspect of the present invention is to provide a sheath for a mason's trowel that grasps the blade of the trowel so as not to fall off from any angle during transport.

Another aspect of the present invention is to provide the sheath with water drain holes.

Another aspect of the present invention is to provide the sheath with a file to sharpen the trowel.

Other aspects of this invention will appear from the following description and appended claims, reference being made to the accompanying drawings forming a part of this specification wherein like reference characters designate corresponding parts in the several views.

BRIEF DESCRIPTION OF THE DRAWINGS

FIG. 3 is a top plan view of the sheath shown in FIG. 1 with section arrows, and without the trowel.

FIG. 4 is a longitudinal sectional view of the sheath taken along lines 4—4 of FIG. 3.

FIG. 5 is a cross sectional view of the sheath taken along lines 5—5 of FIG. 3.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DESCRIPTION OF THE PREFERRED EMBODIMENT

Figure 1:
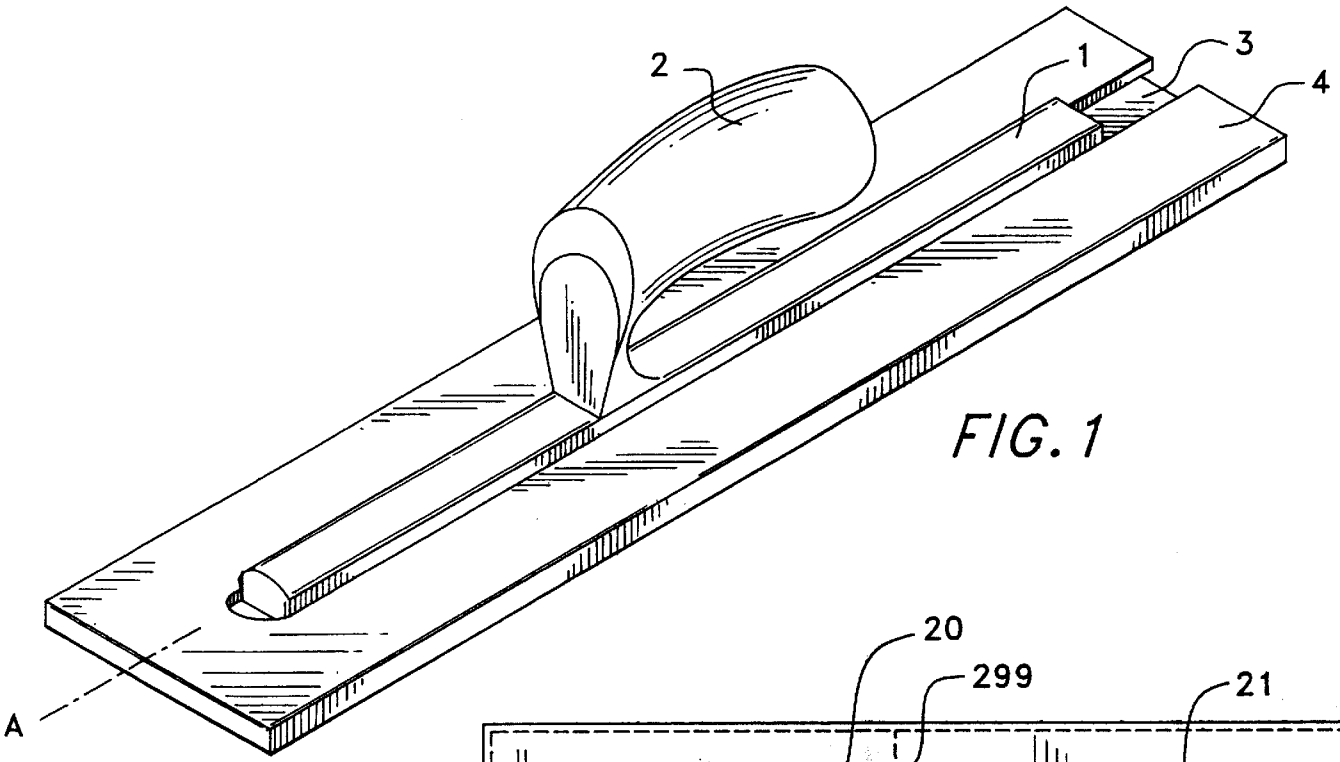
FIG. 1 is a top perspective view of the preferred embodiment sheath covering a mason's trowel, and shown not sliding off even with the trowel pointed down.

Referring first to FIG. 1 a mason's trowel 1 has a handle 2 and a blade 3. The blade 3 is shown as rectangular in shape, but other shapes such as triangular are encompassed by this invention. A sheath 4 has a longitudinal axis A.

Figure 2:
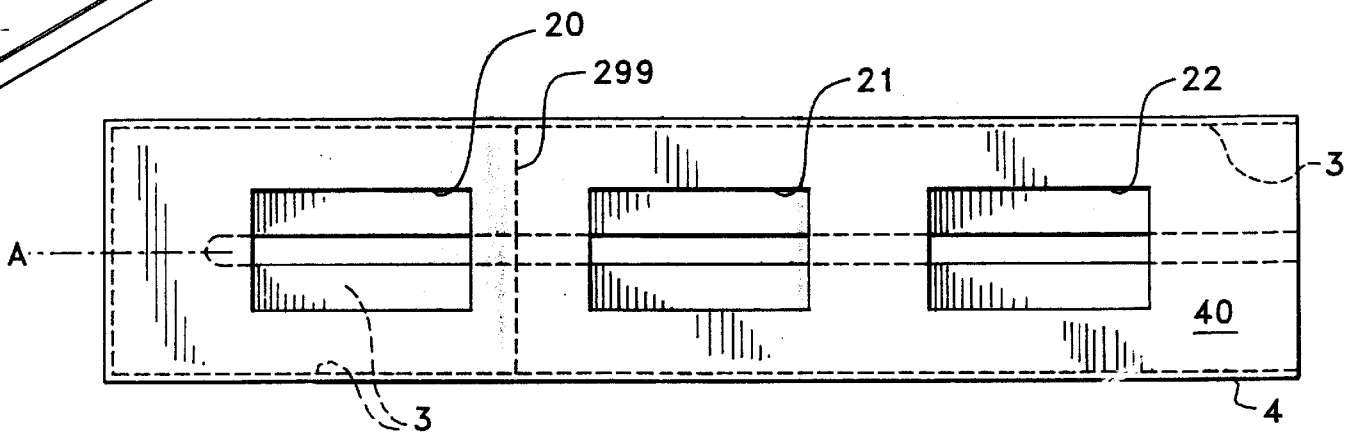
FIG. 2 is a bottom plan view of the sheath shown in FIG. 1 without the trowel.

Referring next to FIG. 2 this blade 3 is shown in dots as well as through the holes 20, 21, 22 which are formed in the bottom surface 40 of the sheath 4. These holes 20, 21, 22 provide for water drainage if a hose is used to clean the blade 3 while sheathed, as well as to prevent standing water from rusting the blade. The dotted line 299 indicates the proximal end of the jaw members 41, 42.

Referring next to FIG. 3 the sheath 4 has a top surface 50. A receiving slot 30 for the trowel handle is formed in the top surface 50. Proximal clamps 31, 32 to secure the blade are shown in dots.

Referring next to FIG. 4 the sheath 4 has at its distal end an internal jaw 400 to grasp the distal end of the blade 3. Jaw 400 has an upper jaw member 41 and a lower jaw member 42. The blade 3 spreads the jaw members apart about one millimeter, thereby providing a grip from the jaw 400 to the blade 3. A space 45 of about ⅛ inch runs along the length of the sheath 4 until the jaw 400 begins. A pair of proximal clamps 32/320 and 31/310 grip the proximal end of the blade 3. The gap 46 between clamp members 32 and 320 and 31 and 310 is sized at slightly less than the gauge of the blade 3. The sheath 4 is preferably made of plastic with a spring memory. Nominal dimensions are $d_1$=⅜" $d_2$=5", $d_3$=20.5", $d_4$=4", $d_5$=1", and $d_6$=¼".

Referring next to FIG. 5 it is shown how openings 51, 52 sized at about ⅛ inch receive the blade edges (FIG. 9, 90, 91) without any need to pry the sheath opening 45 open. The blade 3 is slightly convex pointing downward as shown in FIG. 9.

Figure 6:
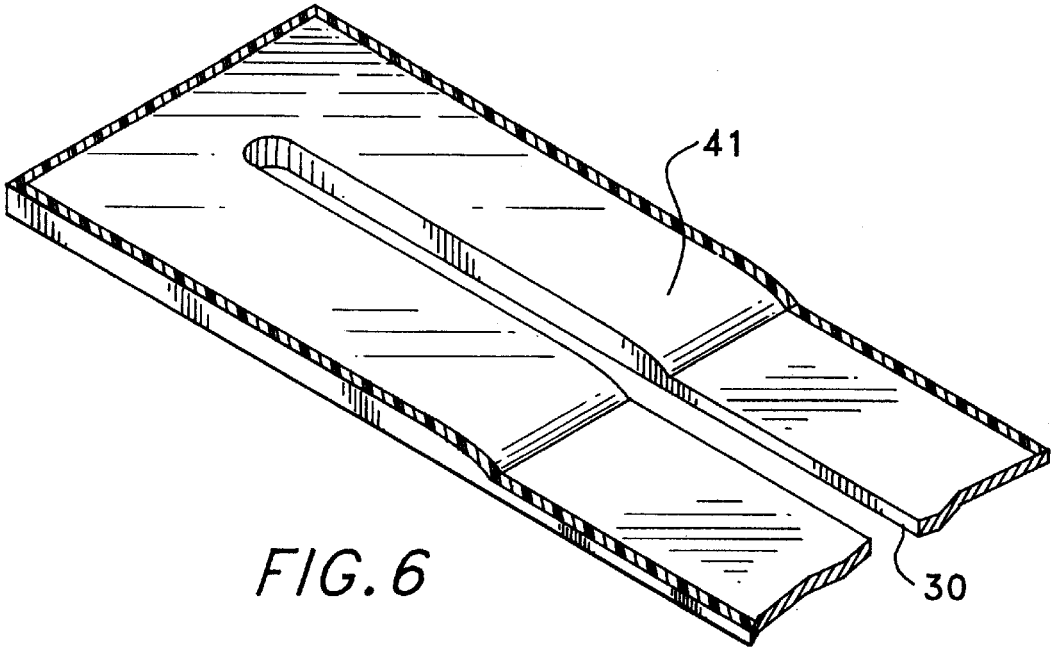
FIG. 6 is a bottom perspective view of the top distal gripping member of the sheath.
Figure 7:
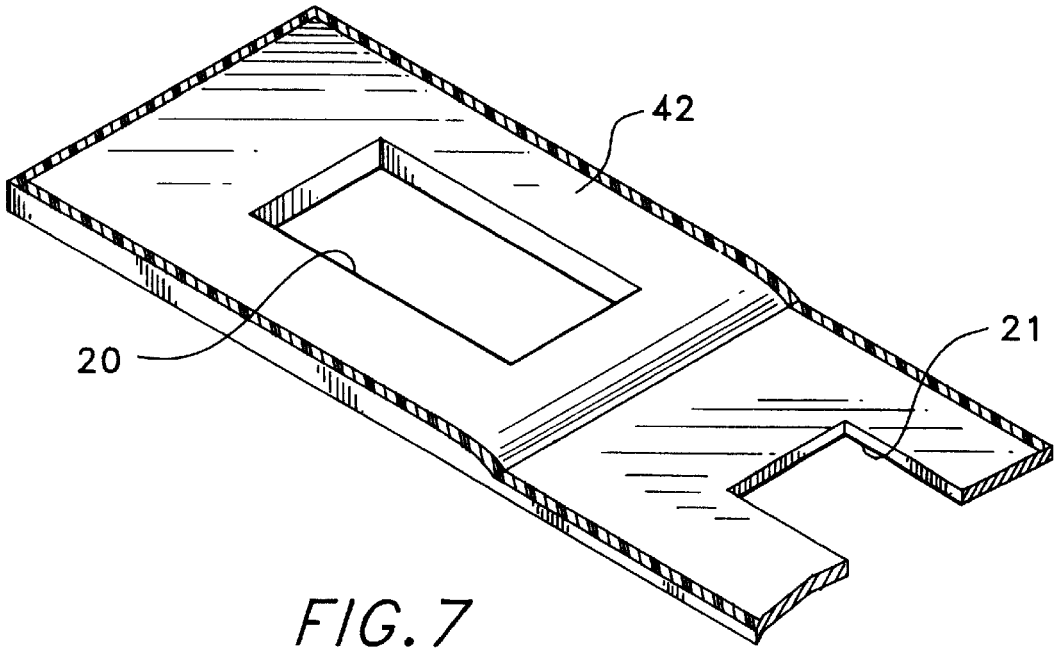
FIG. 7 is a top perspective view of the bottom distal gripping member of the sheath.

FIGS. 6, 7 show the jaw members 41, 42 which by themselves can grip the blade 3 and prevent the sheath 4 from falling off at any angle of transport, as best shown in FIG. 1.

Figures 8, 9:
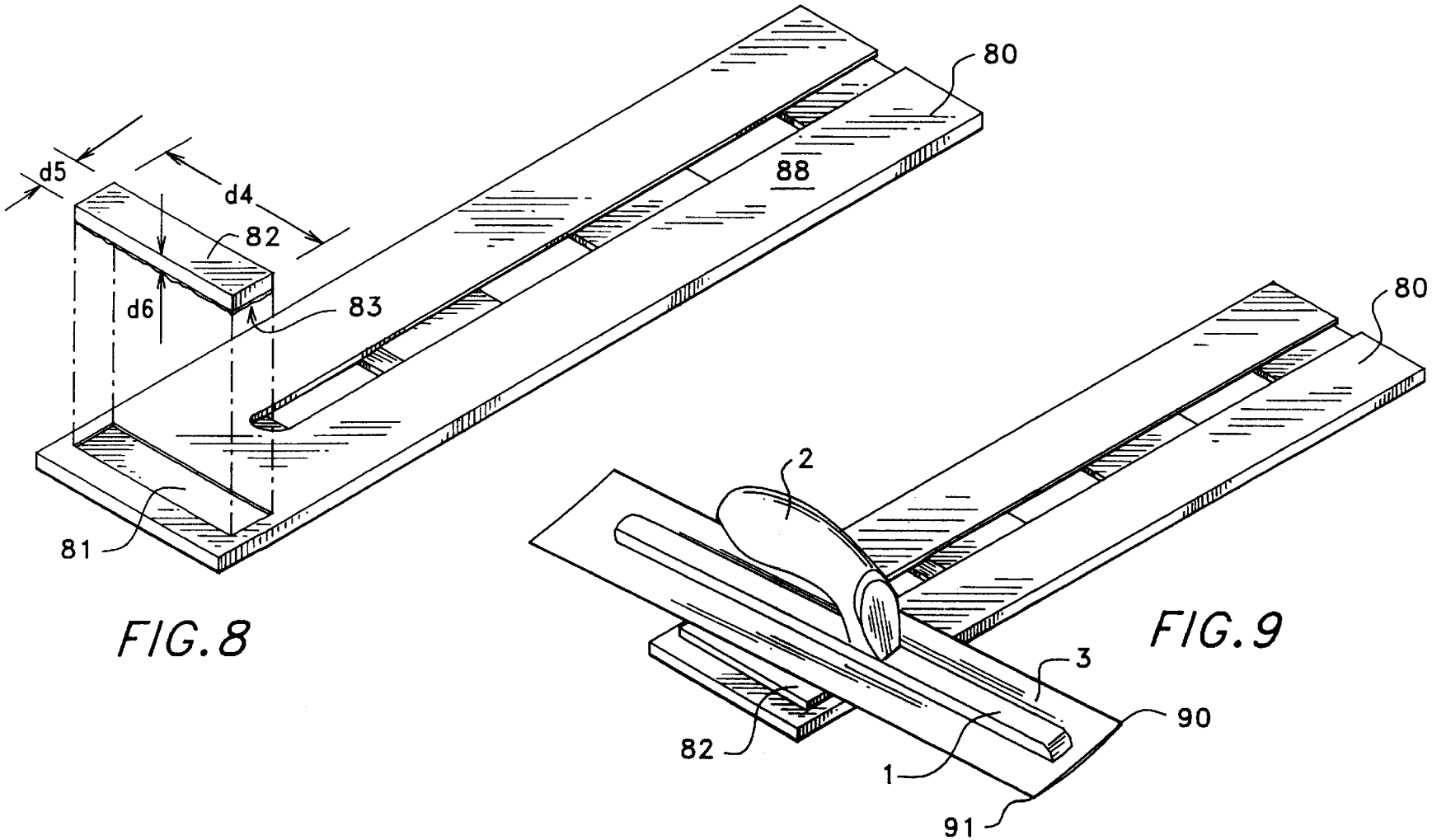
FIG. 8 is an exploded view of an alternate embodiment sheath having a file.
FIG. 9 is a top perspective view of the FIG. 8 embodiment with a trowel being sharpened on the file.

Referring next to FIGS. 8, 9 a sheath 80 has a mounting hole 81 on its top surface 88. A file 82 with glue 83 is secured into hole 81. The trowel blade 3 is shown sharpened along file 82.

Although the present invention has been described with reference to preferred embodiments, numerous modifications and variations can be made and still the result will come within the scope of the invention. No limitation with respect to the specific embodiments disclosed herein is intended or should be inferred.

I claim:

1. In combination with a mason's trowel, the trowel having a flat blade with a length 1, a longitudinal axis, a handle connected to an upper surface of the blade, an improvement comprising:

a sheath having a length of at least 1;

the sheath having a receiving slot for the blade;

the receiving slot having a jaw at a distal end thereof; and the jaw having an upper member and a lower member, each member having a spring resilience to clamp the blade upon insertion thereof into the slot and jaw, thereby holding the sheath to the blade during transport.

2. The combination of claim 1, wherein the receiving slot further comprises a clamp at its proximal end, thereby further holding the sheath to the blade during transport.

3. The combination of claim 1, wherein the sheath further comprises an upper member having a longitudinal slot for receiving the handle of the trowel.

4. The combination of claim 3, wherein the sheath further comprises a lower member having at least one hole, thereby allowing water to drain therethrough.

5. The combination of claim 4, wherein the sheath has a file connected to an outside surface thereof.

6. The combination of claim 3, wherein the trowel and the sheath each have a rectangular shape.

7. The combination of claim 6, wherein the sheath has a construction of plastic.

8. The combination of claim 3, wherein the sheath has a file connected to an outside surface thereof.

9. The combination of claim 1, wherein the sheath has a file connected to an outside surface thereof.

10. A sheath for a mason's trowel, said sheath comprising:

a rectangular shaped block having a size larger than a trowel;

a slot in the block sized to receive a blade of the trowel without any prying open of the slot;

the slot having an internal clamp at a distal end, thereby releasably engaging the blade; and the sheath having an upper member with a longitudinal slot to receive a handle of the trowel wherein the internal clamp further comprises a pair of resilient jaw members.

11. A sheath for a mason's trowel, the sheath comprising:

a body means with a slot means, said body means and slot means together functioning to receive a blade and a handle of the trowel;

said slot means having a jaw means at a distal end, said jaw means functioning to hold the blade during transport; and said slot means having an internal clamp means at a proximal end, said internal clamp means functioning to further hold the blade during transport.

12. The sheath of claim 11, wherein the jaw means comprise an upper and a lower resilient indentation of the slot means.

13. The sheath of claim 12, wherein the body means has a lower member with at least one drainage hole.

14. The sheath of claim 13, wherein the body means has a file connected to it.

15. The sheath of claim 13, wherein the body means has a construction of plastic.

16. A sheath for a mason's trowel, said sheath comprising:

a rectangular shaped block having a size larger than a trowel;

a slot in the block sized to receive a blade of the trowel without any prying open of the slot;

the slot having an internal clamp at a distal end, thereby releasably engaging the blade;

the sheath having an upper member with a longitudinal slot to receive a handle of the trowel; and wherein the sheath has a lower member with at least one drain hole.

17. The sheath of claim 16, wherein the sheath further comprises a file attached to an outer surface.

18. The sheath of claim 16, wherein the slot further comprises a clamp at its proximal end to further hold the blade.

* * * * *